US008459345B2

(12) United States Patent
Bell

(10) Patent No.: US 8,459,345 B2
(45) **Date of Patent: *Jun. 11, 2013**

(54) EXTENDED REACH WHIPSTOCK

(75) Inventor: Douglas Bruce Bell, Singapore (SG)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/487,668

(22) Filed: Jun. 4, 2012

(65) Prior Publication Data

US 2012/0241144 A1 Sep. 27, 2012

Related U.S. Application Data

(63) Continuation of application No. 12/972,699, filed on Dec. 20, 2010, now Pat. No. 8,230,920.

(51) Int. Cl.
*E21B 41/04* (2006.01)

(52) U.S. Cl.
USPC ..... 166/117.5; 166/117.6; 166/341

(58) Field of Classification Search
USPC ..... 166/341, 255.2, 255.3, 117.5, 117.6, 166/50
See application file for complete search history.

(56) References Cited

U.S. PATENT DOCUMENTS

| | | | | |
|---|---|---|---|---|
| 4,068,729 | A | 1/1978 | Peevey | |
| 4,733,732 | A | 3/1988 | Lynch | |
| 5,425,419 | A | 6/1995 | Sieber | |
| 6,244,340 | B1 * | 6/2001 | McGlothen et al. | 166/255.3 |
| 6,968,903 | B2 | 11/2005 | Pollard | |
| 7,353,867 | B2 | 4/2008 | Carter et al. | |
| 7,422,057 | B2 | 9/2008 | Lewis et al. | |
| 7,484,575 | B2 | 2/2009 | Angelle et al. | |
| 2003/0192700 | A1 | 10/2003 | Murray et al. | |
| 2006/0243436 | A1 | 11/2006 | Angelle | |
| 2009/0266559 | A1 | 10/2009 | Horvath et al. | |
| 2010/0012322 | A1 | 1/2010 | McGarian | |
| 2010/0059279 | A1 | 3/2010 | Saylor | |

* cited by examiner

*Primary Examiner* — Brad Harcourt
*Assistant Examiner* — Robert E Fuller
(74) *Attorney, Agent, or Firm* — E Randall Smith; Jones & Smith, LLP

(57) ABSTRACT

A whipstock assembly includes a pivotable deflector movable from a retracted to a deployed position. In the deployed position, the deflector is capable of guiding a tubular member away from the whipstock.

20 Claims, 6 Drawing Sheets

EXTENDED REACH WHIPSTOCK

This application is a continuation of and claims priority to U.S. patent application Ser. No. 12/972,699 filed Dec. 20, 2010, entitled "Extended Reach Whipstock and Methods of Use", which is hereby incorporated by reference herein in its entirety.

FIELD OF THE DISCLOSURE

The present disclosure relates generally to whipstocks and the use thereof, and more particularly, to apparatus and methods useful to increase the distance the item being guided by the whipstock is deflected away from the whipstock.

BACKGROUND

In hydrocarbon exploration and production operations, whipstocks are commonly used to guide a drill for milling a window in a well bore casing or slant-drill through the side of a well bore. Whipstocks are also often useful to guide a conductor shoe or pipe, working string, drill or other item for forming a new well bore adjacent to an existing well. As used herein, the term "tubular member" means an item that can be guided by a whipstock, such as, depending upon the application, a conductor shoe or pipe, working string, drill, drill bit or a combination thereof. In many situations, such as in offshore drilling operations, a common challenge is to prevent hang-up of the tubular member on structural components located at the existing well location.

Various presently known whipstock technologies are believed to have one or more limitations. For example, when forming new well bores adjacent to existing wells, various known whipstocks are believed to be capable of only directing the tubular member over the outer diameter of the existing well stump and not over adjacent structural components that may be present at the site. Consequently, when an obstruction is encountered during whipstock operations at offshore sites, it is often necessary to send divers to the sea floor to pull the pipe across the obstruction(s) or abandon the effort completely. For another example, some presently known whipstocks allow the tubular member to roll off the whipstock center, decreasing the accuracy of azimuth target achievement.

It should be understood that the above-described examples, features and potential limitations are provided for illustrative purposes only and are not intended to limit the scope or subject matter of this disclosure or any related patent application or patent. Thus, none of the appended claims or claims of any related patent application or patent should be limited by the above examples, features and potential limitations or required to address, include or exclude the above-cited examples, features and/or potential limitations merely because of their mention above.

Accordingly, there exists a need for improved whipstocks and related systems and methods for guiding a tubular member having one or more of the attributes, capabilities or features listed below or as may be described in or evident from the subsequent sections of this disclosure, appended claims and drawings: utilizes a self-actuated deflector to force the tubular member a sufficient distance from the whipstock or existing well bore; utilizes a deflector that is actuated upon landing the whipstock in an existing well bore stump; utilizes a deflector actuator that includes a setting ring and biasing member; utilizes a hydraulically or pneumatically actuated deflector to force the tubular member a sufficient distance from the whipstock or existing well bore; utilizes a deflector delivered in a retracted position to allow the whipstock to pass through one or more pipe guides and movable into a deployed position to guide the tubular member as desired; assists in eliminating the need for prolonged diver operations to ensure proper clearance of a tubular member around existing structural components at offshore locations; assists in preventing hang-up of the tubular member on structural components at the well site, such as conductor guide frames, funnels or other mud-line jacket components; prevents roll-off of the tubular member from the whipstock; may assist in forcing the tubular member away from the existing well bore center up to approximately 150% of the existing stump diameter; may be useful at or below mud-line at offshore drilling sites or at or below surface at land-based drilling sites.

BRIEF SUMMARY OF THE DISCLOSURE

In some embodiments, the present disclosure involves a whipstock assembly useful for guiding a tubular member to a location proximate to an existing well bore. The whipstock assembly includes an elongated body having a longitudinal axis extending from its upper end to its lower end and an outer slide surface extending at least partially along the longitudinal axis. The outer slide surface is inclined at least partially between the upper and lower ends of the elongated body and useful to slideably engage and guide the tubular member as it moves downwardly along the elongated body.

In these embodiments, in accordance with the present disclosure, at least one cut-out is formed in the elongated body. A pivotable deflector is disposed at least partially within the elongated body in a retracted position and configured to be pivotable at least partially through the cut-out to a deployed position. In the deployed position, the deflector protrudes at least partially out of the elongated body through the cut-out. The deflector includes a deflector surface. When the deflector is in the deployed position, the deflector surface is at least partially inclined at an outwardly sloping angle that is greater than the incline angle of the outer slide surface and slideably engageable with the tubular member. The deflector is configured to support the tubular member while guiding it farther away from the existing well bore than the outer slide surface of the elongated whipstock body as the tubular member passes downwardly along the elongated body and deflector. At least one elongated linear-shaped pusher is at least partially disposed within the elongated body and extends at least partially along the longitudinal axis thereof. The pusher is engageable with the deflector and movable between first and second positions. The pusher is configured so that its movement from its first position to its second position causes the deflector to pivot from its retracted position to its deployed position. In the second position, the pusher is configured to retain the deflector in its deployed position as the deflector supports the tubular member slideably engaging the deflector surface.

In various embodiments, the present disclosure involves apparatus useful for guiding a conductor pipe away from mud-line jacket structural components that are associated with an existing well bore at an offshore hydrocarbon drilling site and located proximate to the stump of the existing well bore at or near the mud-line. The apparatus includes an elongated whipstock body, a pivotable deflector and at least one rod engageable with the deflector. The deflector is initially disposed within the whipstock body and is pivotably moveable to a deployed position where it protrudes at least partially out of the whipstock body. In its deployed position, the deflector is configured to support the weight of the conductor pipe while guiding it away from the mud-line jacket structural components. The rod is disposed at least partially within the whipstock body, movable between first and second positions and engageable with the deflector. The rod is configured so that its movement from its first position to its second position causes the deflector to pivot into its deployed position. In its second position, the rod is configured to prevent the deflector from moving back into the whipstock body so that the deflector, in its deployed position, supports the weight of the conductor pipe while guiding it away from the mud-line jacket structural components.

Accordingly, the present disclosure includes features and advantages which are believed to enable it to advance whipstock technology. Characteristics and potential advantages of the present disclosure described above and additional potential features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PRESENTLY PREFERRED EMBODIMENTS

Figure 1:
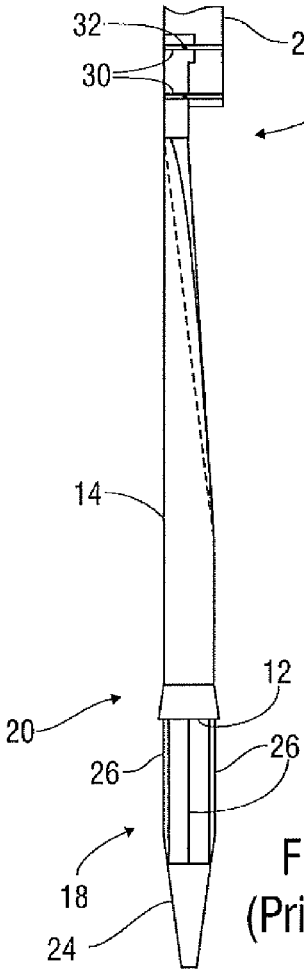
FIG. 1 (Prior Art)
FIG. 1 is a side view of an example prior art whipstock assembly.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent application, any patent granted hereon or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments, common or similar elements are referenced in the appended figures with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged", "carried" and the like, and variations thereof, as used herein and in the appended claims are intended to mean either an indirect or direct connection or relationship. For example, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Referring initially to FIG. 1, an example prior art whipstock assembly 10 is shown including an elongated body 14, sometime referred to a half-pipe, and an elongated nose 18. As used herein, the term "elongated" means having a length greater than its width. The nose 18 is typically rigidly connected to the lower end 20 of the body 14. For example, a mounting plate 12 may be bolted to the bottom of the body 14 and welded to the nose 18. The upper end 22 of the body 14 is typically releasably engageable with a tubular member 28, such as with the use of one or more clamps 30 connected to the body 14 with shear studs 32.

Figure 2:
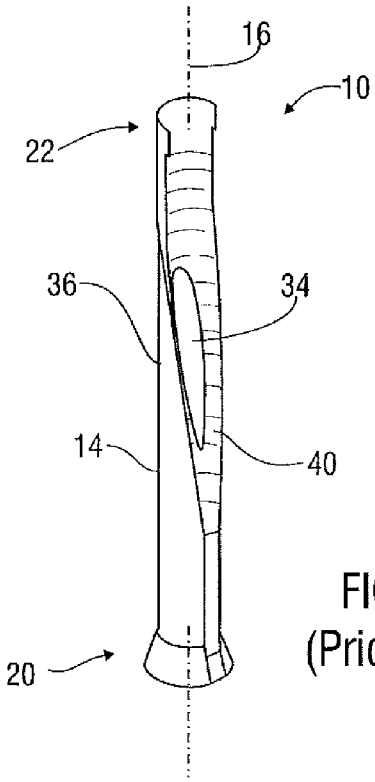
FIG. 2 (Prior Art)
FIG. 2 is a perspective view of the elongated body of the exemplary prior art whipstock assembly of FIG. 1.

Referring to FIG. 2, the elongated body 14 of the illustrated prior art whipstock assembly 10 is shown including an internal space 34, an outer shell 36 and an outer slide surface 40. The illustrated outer slide surface 40 is concave and extends at least partially along the longitudinal axis 16 of the body 14. The outer slide surface 40 is inclined at least partially between the upper and lower ends 22, 20 of the body 14 to provide a guide path for the tubular member 28 (e.g. FIG. 1) as the tubular member 28 ultimately passes downwardly along the body 14 from its upper end 22. In some applications, for example, the outer slide surface 40 may urge the tubular member 28 outwardly against a surrounding tubular (not shown), such as a casing, in order to mill a window in the casing that will serve as a lateral borehole. In other applications, the outer slide surface 40 may guide the tubular member 28 along the outside of the whipstock assembly 10 into the earth to form a new primary well bore adjacent to the existing well bore.

Referring back to the prior art example of FIG. 1, the illustrated nose 18 is a bull nose spear 24 with multiple fins 26 for assisting in guiding the nose 18 into an anchor (not shown), such as a packer disposed in a well bore or stump at an offshore drilling site. In operation of the illustrated prior art example, after the nose 18 is landed in an anchor, the shear studs 32 will shear and the clamps 30 will separate from the whipstock assembly 10 and/or tubular member 28, allowing the tubular member 28 to move down along the outer slide surface 40 (FIG. 2). It should be understood that the above components and operation may take other forms, and that additional components and operations may be included. Moreover, the present disclosure and appended claims are not limited to the components, operation or other details described above or shown in the associated figures.

Now referring to FIG. 3, a whipstock assembly 50 in accordance with an embodiment of the present disclosure will now be described. In this embodiment, at least one window, or cut-out, 54 is formed in the elongated body 14 generally proximate to the outer slide surface 40. The cut-out 54 provides access to the space 34 inside the body 14. In this example, the cut-out 54 is located proximate to the lower end 20 of the body 14. However, there may be instances where the cut-out 54 is formed at a different location on the body 14 or multiple cut-outs 54 may be formed at different locations.

Figure 3:
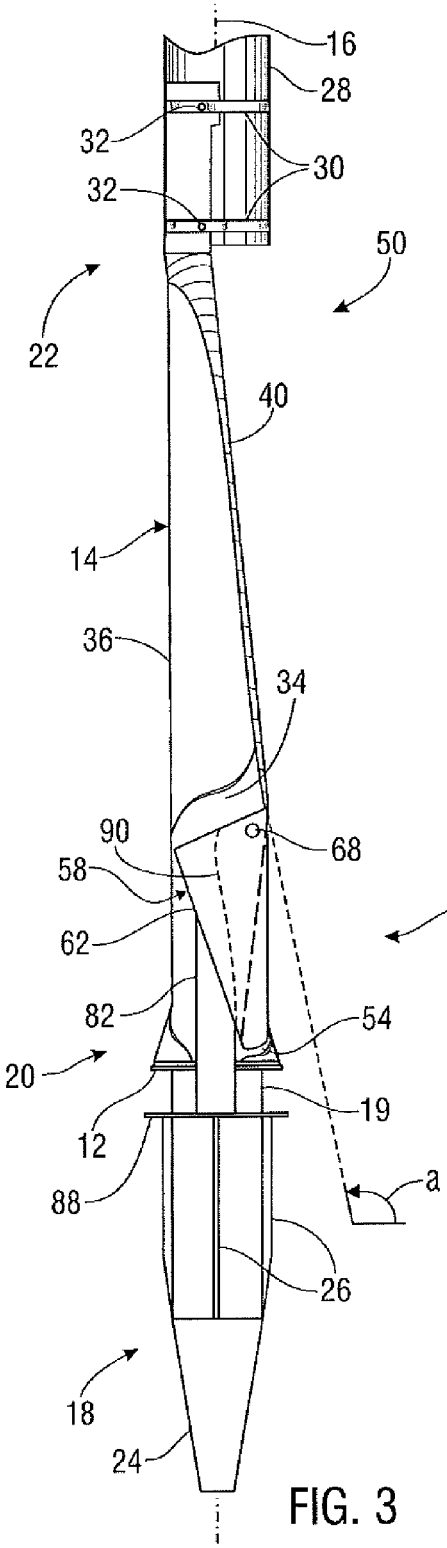
FIG. 3 is a side view of an embodiment of a whipstock assembly in accordance with the present disclosure shown engaged with a tubular member.

Still referring to the embodiment of FIG. 3, an extendable deflector 58 is shown disposed within the space 34 in an initial retracted position. While the deflector 58 of this example is shown positioned entirely within the space 34 in its retracted position, the deflector 58 may, in other embodiments, be only partially disposed within the space 34 in a retracted position or have multiple retracted positions. Further, it should be noted that the assembly 50 may include multiple spaces 34, cut-outs 54 and/or deflectors 58.

Figure 4:
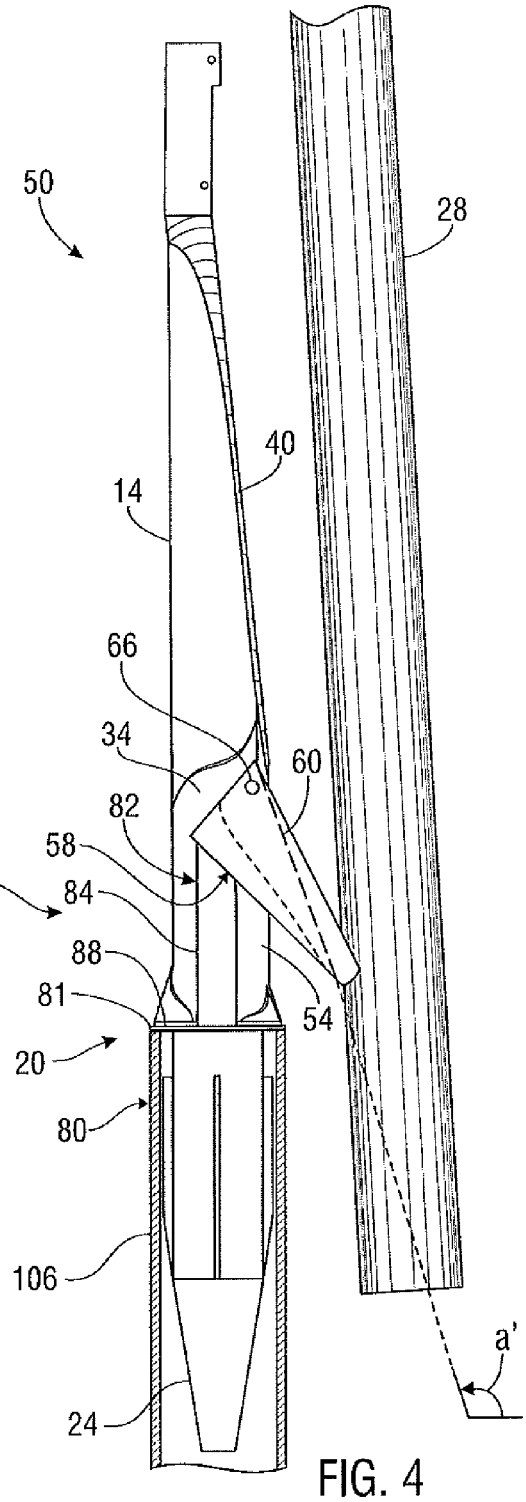
FIG. 4 shows the exemplary whipstock assembly of FIG. 3 deployed within an exemplary anchor and illustrating its exemplary deflector in a deployed position.

The exemplary deflector 58 is configured to be movable through the cut-out 54 from the retracted position to a deployed position, such as shown in FIG. 4. In the deployed position, the exemplary deflector 58 protrudes at least partially out of the elongated body 14 through the cut-out 54. The illustrated assembly 50 is configured so that the deflector 58 may be held in the deployed position. However, other embodiments may include a deflector 58 that is also retractable from at least one deployed to at least one retracted position.

Referring to FIG. 4, the illustrated deflector 58 includes a deflector surface 60 that is generally longitudinally alignable with the outer slide surface 40 of the body 14 when the deflector 58 is in a deployed position. The exemplary deflector surface 60 thus effectively serves as a continuation path of the outer slide surface 40. However, when the detector surface 60 is in this position, it is at least partially inclined at an outwardly sloping angle $\alpha'$ that is greater than the incline angle $\alpha$ (e.g. FIG. 3) of the outer slide surface 40. Accordingly, the illustrated deflector 58, in a deployed position, is capable of guiding the downwardly moving tubular member 28 farther away from the body 14 than the outer slide surface 40.

Figure 5:
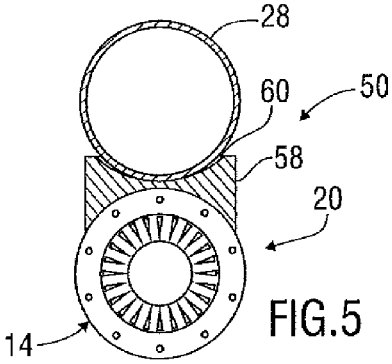
FIG. 5 is a partial cross-sectional view of the exemplary deflector of FIG. 3 shown in a deployed position.

The deflector 58 and deflector surface 60 may have any suitable dimensions, such as to achieve a particular deflected distance or angle. If desired, the deflector 58 may be configured to assist in retaining the tubular member 28 in position relative to the whipstock assembly 50 when it is engaged with the deflector surface 60. For example, the deflector surface 60 may be trough-shaped, concave or curved (e.g. FIG. 5), such as to assist in preventing the tubular member 28 from rolling off the whipstock assembly 59, or moving out of alignment with the longitudinal axis 16 (FIG. 3) of the elongated body 14 when the tubular member 28 is slideably engaged with the deflector 58.

Figure 6:
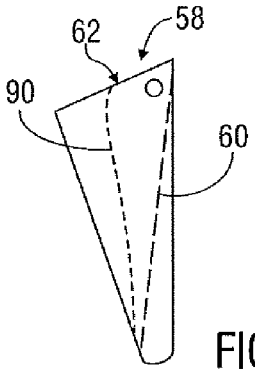
FIG. 6 is an isolated view of the exemplary deflector of FIG. 3.
Figure 9:
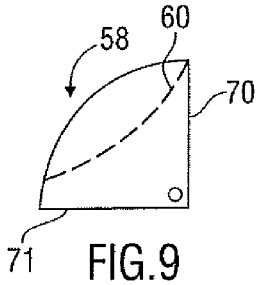
FIG. 9 is an isolated view of the exemplary deflector of FIG. 7.
Figure 7:
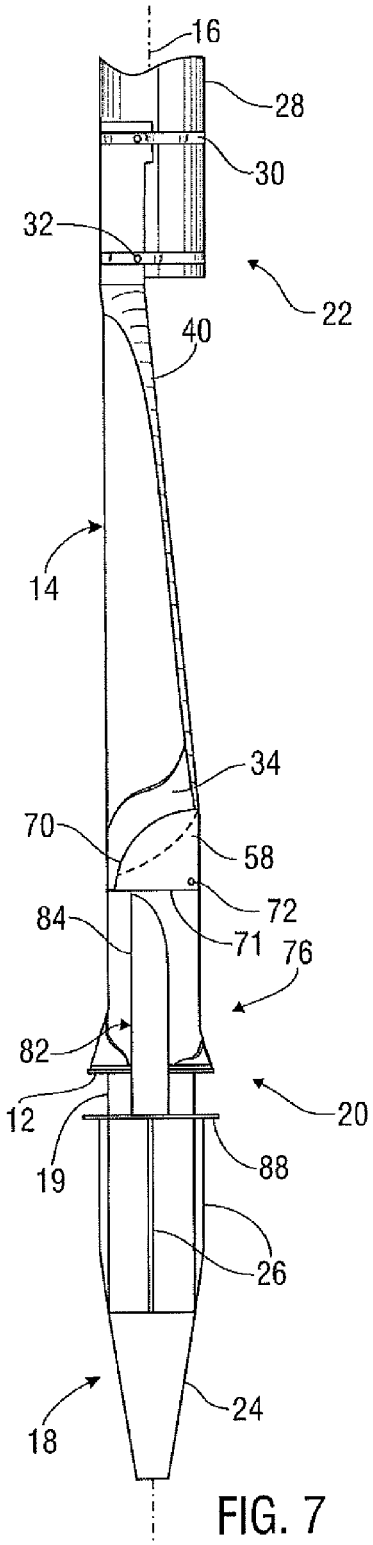
FIG. 7 is a side view of another embodiment of a whipstock assembly in accordance with the present disclosure shown engaged with a tubular member.
Figure 8:
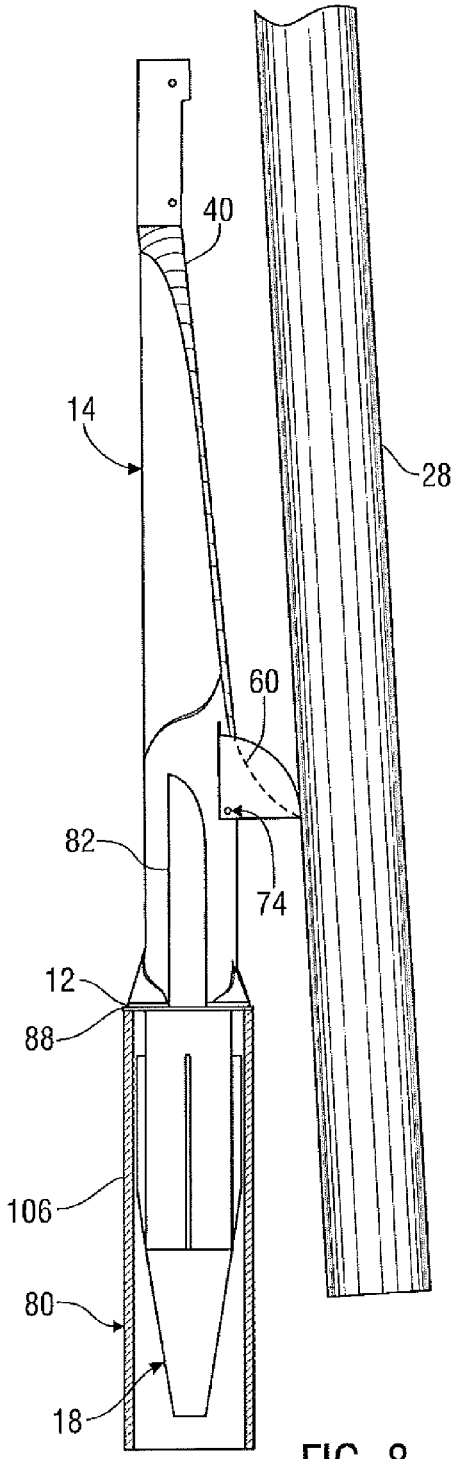
FIG. 8 shows the exemplary whipstock assembly of FIG. 7 deployed within an exemplary anchor and illustrating its exemplary deflector in a deployed position.

The extendable deflector 58 may have any suitable form, configuration and operation. For example, in the embodiment of FIGS. 3-4, the deflector 58 is pivotably moveable relative to the body 14 from a retracted position to a deployed position. In this example, the illustrated deflector 58 is a push-out type guide member 62 (see also FIG. 6) that is pivotably connected to the body 14 by an upper hinge 66, such as, for example, a hinge pin 68. In another example, as shown in FIGS. 7-9, the deflector 58 is a flip-over type guide member 70 that is pivotably connected to the body 14 by a lower hinge 72, such as a hinge pin 74. However, in other embodiments, the deflector 58 may have a different connection arrangement in the whipstock assembly 50.

The deflector 58 may be moved into a deployed position in any desired manner. In some embodiments, the whipstock assembly 50 may be configured so that the deflector 58 is self-actuated, or automatically moves, into a deployed position at a desired time or event. For example, the whipstock assembly 50 of FIGS. 3-4 includes a deflector actuator 76 that responsively urges the deflector 58 into the deployed position as the nose 18 is inserted into an anchor 80. When included, the deflector actuator 76 may have any suitable form, configuration and operation. In the illustrated example, the deflector actuator 76 includes a weight-set setting ring 88 and at least one biasing member 82, such as a pair of rods 84. The exemplary setting ring 88 and rods 84 are depicted in FIGS. 10-12.

Figure 13A:
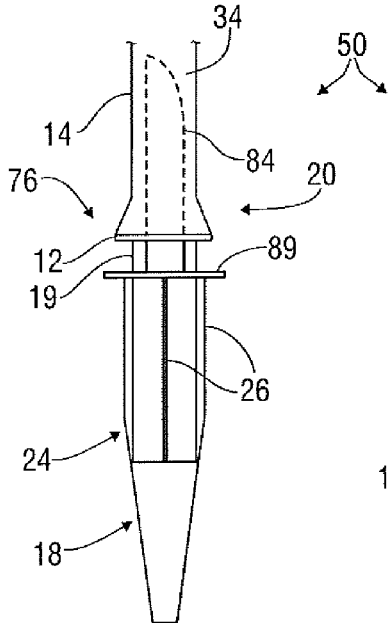
FIG. 13A is a side view of the exemplary deflector actuator of FIG. 3 showing the exemplary setting ring in a position near the mid-point of the upper portion of the exemplary nose.
Figure 13B:
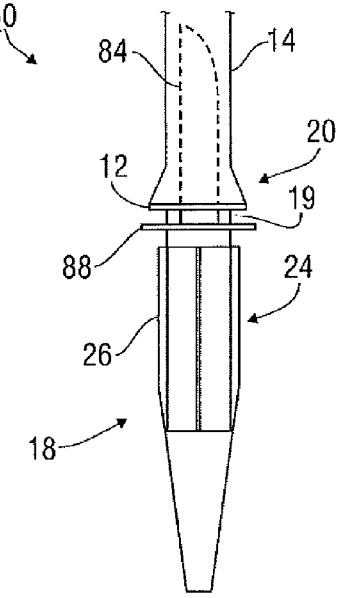
FIG. 13B is a side view of the exemplary deflector actuator of FIG. 3 showing the setting ring in a position at the top of the fins of the exemplary nose.

As shown in FIGS. 13A-13B, when the whipstock assembly 50 of this embodiment is assembled, the setting ring 88 is disposed around an upper portion 19 of the nose 18 and is freely longitudinally slideable between the top of the fins 26 and the lower end 20 of the body 14. To illustrate this arrangement, FIG. 13A shows the setting ring 88 abutting the top of the fins 26 and FIG. 13B shows the setting ring 88 at a position near the mid-point of the upper portion 19 of the nose 18. The setting ring 88 of this example is formed with an outer diameter 90 and width 92 (e.g. FIG. 11) so that it will land or rest upon the upper end 81 of the anchor 80 (e.g. FIGS. 14) as the nose 18 is moved into the anchor 80.

Figure 11:
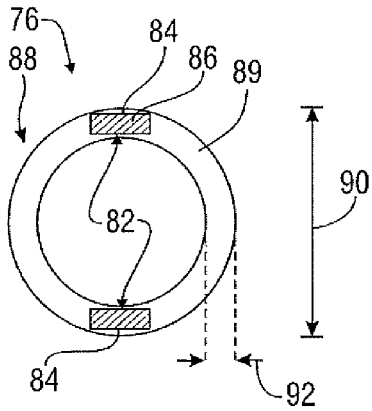
FIG. 11 is a top view of the exemplary deflector actuator of FIG. 10.
Figure 10:
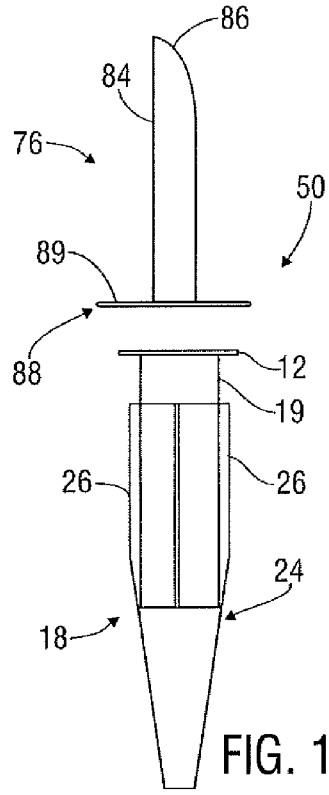
FIG. 10 is an isolated view of the nose and deflector actuator of the exemplary whipstock assembly of FIG. 3.
Figure 12:
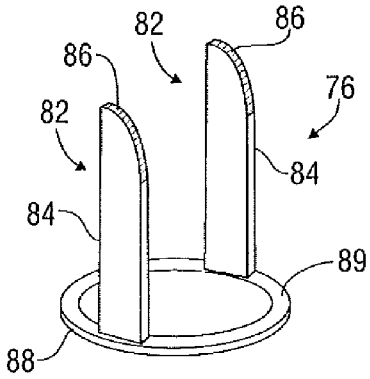
FIG. 12 is a perspective view of the exemplary deflector actuator of FIG. 11.

Referring to FIG. 10, the exemplary rods 84 are rigidly connected to the upper face 89 of the setting ring 88 and extend upwardly therefrom (see also FIGS. 11-12). When the illustrated whipstock assembly 50 is assembled, the rods 84 extend into the space 34 (e.g. FIG. 13A) of the body 14. In this embodiment, the upper end of each rod 84 has a cam profile 86 (e.g. FIG. 12) that engages a corresponding cam profile 90 (e.g. FIG. 6) of the deflector 58. However, the rods 84 and/or deflector(s) 58 may not have cam profiles. For example, the rods 84 and deflector 58 of FIGS. 7-8 does not have cam profiles. Instead, the base 71 of the flip-over guide member 70 has a flat surface that is urged upwardly by the rods 84. As will be described below, the illustrated whipstock assembly 50 is arranged so that as the nose 18 is inserted into the anchor 80 (e.g. FIG. 4), the setting ring 88 engages the top edge 81 of the anchor 80 and the rods 84 force the deflector 58 to pivot about the hinge 66 and move out of the cut-out 54.

Figure 14:
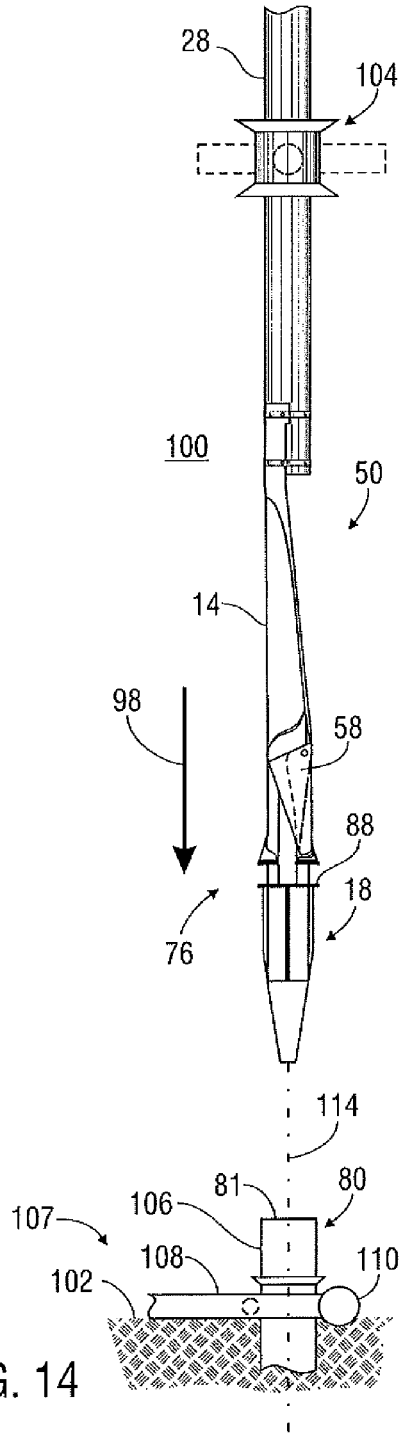
FIG. 14 is a side view of the exemplary whipstock assembly of FIG. 3 shown being lowered to an offshore well site.

Referring now to FIG. 14, a method of use of the exemplary whipstock assembly 50 of FIG. 4 in accordance with an embodiment of the present disclosure will now be described. This example involves the use of the whipstock assembly 50 in an offshore or subsea drilling situation. However, the whipstock assembly 50 and other embodiments of the present disclosure are not limited to subsea use, but may also be used in land-based operations. Moreover, it should be understood that the illustrated whipstock assembly 50 is not required for practicing the exemplary method or other methods of the present disclosure. Any suitable components may be used. Also, the present disclosure is not limited to the particular methods described below, but includes various methods in accordance with the principals of the present disclosure.

Figure 15:
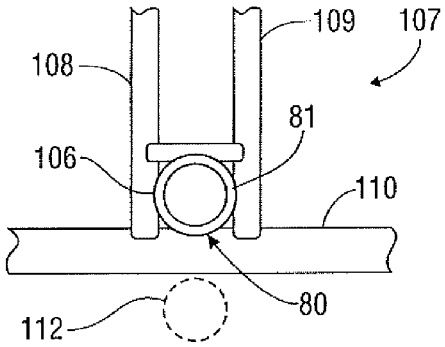
FIG. 15 is an isolated top view of the exemplary mud-line jacket structure shown in FIG. 14.
Figure 16:
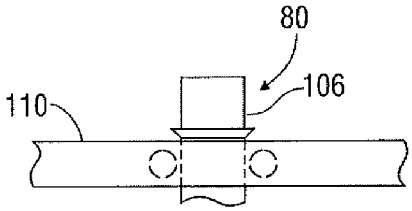
FIG. 16 is an isolated front view of the exemplary mud-line jacket structure of FIG. 14.
Figure 17:
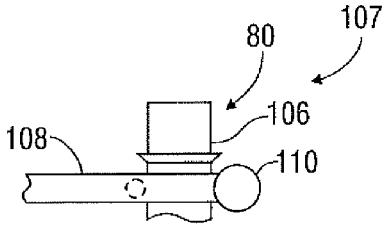
FIG. 17 is an isolated side view of the exemplary mud-line jacket structure of FIG. 14.

As shown in FIG. 14, in this embodiment, the tubular member 28 and suspended whipstock assembly 50 are lowered into the sea or other body of water 100, as is and becomes further known. For example, the whipstock assembly 50 and tubular member 28 may be lowered through one or more pipe guide 104 to an anchor 80. The pipe guide 104 and anchor 80 may have any form and configuration, as is and become further known. One example of a pipe guide 104 is a conductor guide disposed at a location above an existing or abandoned well bore (e.g. FIG. 14). An example anchor 80 is a stump 106, such as a conductor stump, extending upwardly from the existing well bore at the sea floor or mud-line 102. The stump 106 may be located adjacent to other components on, or proximate to, the mud-line 102. For example, referring to FIG. 15, a mud-line jacket structure 107 of the existing well bore may be in place around or proximate to the stump 106 and include various components, such as guide frame bars 108, 109 and 110 (see also FIGS. 16-17). However, the jacket structure 107 may have other components, and additional or different component or materials may be located proximate to the anchor 80. Moreover, the present disclosure and appended claims are not limited by the presence, type, configuration or other characteristics of the guide 104, anchor 80 and any other components or materials at the mud-line 102 or well site.

Referring back to FIG. 14, the exemplary whipstock assembly 50, having its deflector 58 in a retracted position within the profile of the assembly 50, is configured to fit through the pipe guide(s) 104 as it moves toward the anchor 80 in the direction represented by arrow 98. After the assembly 50 passes through the lowermost guide 104, the exemplary deflector 58 is moved into and retained in a deployed position to assist in guiding the tubular member 28 away from the whipstock 50, such as to a new target well bore location 112 (see FIG. 15).

Figure 18:
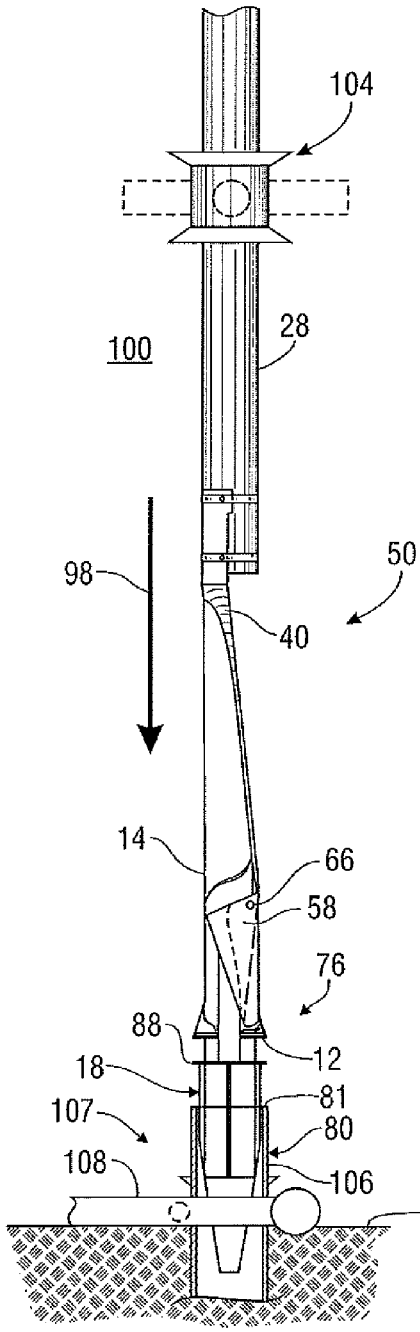
FIG. 18 shows the exemplary whipstock assembly of FIG. 14 being lowered into an exemplary anchor.
Figure 19:
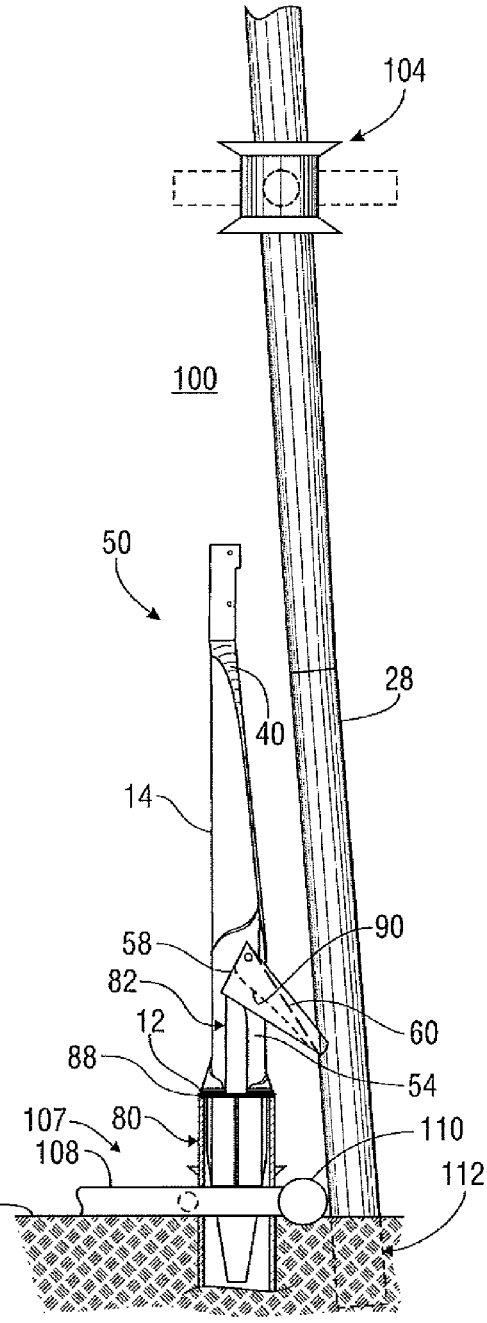
FIG. 19 shows the exemplary whipstock assembly of FIG. 18 with its deflector in a deployed position and guiding the exemplary tubular member away from the mud-line jacket structure.

The deflector 58 may be movable into and held in a deployed position in any suitable manner. In the illustrated embodiment, as shown in FIGS. 18-19, when the whipstock assembly 50 is seated in the anchor 80, the deflector 58 is moved into a deployed position. For example, as the exemplary nose 18 moves into the anchor 80, the exemplary setting ring 88 lands on the upper end 81 of the anchor 80. Now with the setting ring 88 in a fixed position, the continued movement of the illustrated whipstock assembly 50 to sufficiently seat the nose 18 in the anchor 80 (FIG. 16) causes the biasing members 82 to move the deflector 58 out of the cut-out 54 to its deployed position. This may be accomplished, for example, by the weight of the whipstock assembly 50 and tubular member 28 and/or the application of additional force thereto. In this particular embodiment, the cam profile 86 of the rods 84 (FIG. 12) will engage the cam profile 90 of the deflector 58, causing the deflector 58 to pivot about the hinge 66 and move from a retracted position to a deployed position.

In other embodiments, the deflector 58 may be moved into and held in a deployed position at any desired time after the whipstock assembly 50 passes through the lowermost guide 104. For example, without the need for a setting ring 88, the deflector 58 may be moveable between positions and held in a deployed position by an associated hydraulic or pneumatic cylinder (not shown) actuated from the surface, by an ROV or otherwise as desired.

Referring to FIG. 19, after the illustrated nose 18 is seated in the anchor 80, the weight of the tubular member 28 and/or application of force thereto will cause the shear studs 32 to shear and the tubular member 28 to separate from the whipstock assembly 50 and move along the outer slide surface 40, as is and becomes further know. In this embodiment, the tubular member 28 will also move along the deflector surface 60 of the deflector 58, guiding the tubular member 28 farther away from the whipstock assembly 50. In this embodiment, when the nose 18 is sufficiently seated in the anchor 80, the weight of the tubular member 28 on the whipstock assembly 50 will assist in retaining the exemplary rods 84 in engagement with the deflector 58 and holding the deflector 58 in the deployed position.

In some applications, the deflector 58 may cause the tubular member 28 to be directed farther away from the existing well bore center 114 (FIG. 14), such as to the target well location 112, avoiding contact with or hang-up in the jacket structure 107, particularly the bar 110. In some instances, the deflector 58 may assist in forcing the tubular member 28 away from the existing well bore center 114 up to approximately 150% of the diameter of the existing stump 106. For another example, the deflector 58 may assist in retaining the tubular member 28 in position relative to the whipstock assembly 50 when engaged therewith, preventing roll-off of the tubular member 28 from the assembly 50 and enhancing azimuth target achievement.

Preferred embodiments of the present disclosure thus offer advantages over the prior art and are well adapted to carry out one or more of the objects of this disclosure. However, the present disclosure does not require each of the components and acts described above and is in no way limited to the above-described embodiments, methods of operation, variables, values or value ranges. Any one or more of the above components, features and processes may be employed in any suitable configuration without inclusion of other such components, features and processes. Moreover, the present disclosure includes additional features, capabilities, functions, methods, uses and applications that have not been specifically addressed herein but are, or will become, apparent from the description herein, the appended drawings and claims. For example, embodiments of the whipstock assembly 50 of the present disclosure may be configured to be used at any desired location, such as above, at or below the mud-line at offshore drilling sites, or at the surface or underground at onshore drilling sites. For another example, embodiments of the whipstock assembly 50 of the present disclosure may be configured to be lowered via coiled tubing and not initially engaged with the tubular member 28 that will be guided thereby.

The methods that are provided in or apparent from this disclosure or claimed herein, and any other methods which may fall within the scope of the appended claims, may be performed in any desired suitable order and are not necessarily limited to any sequence described herein or as may be listed in the appended claims. Further, the methods of the present disclosure do not necessarily require use of the particular embodiments shown and described herein, but are equally applicable with any other suitable structure, form and configuration of components.

While exemplary embodiments have been shown and described, many variations, modifications and/or changes of the system, apparatus and methods of the present disclosure, such as in the components, details of construction and operation, arrangement of parts and/or methods of use, are possible, contemplated by the patent applicant, within the scope of the appended claims, and may be made and used by one of ordinary skill in the art without departing from the spirit or teachings of this disclosure and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. A whipstock assembly useful for guiding a tubular member to a location proximate to an existing well bore, the whipstock assembly including an elongated body having a longitudinal axis extending from its upper end to its lower end and an outer slide surface extending at least partially along the longitudinal axis, the outer slide surface being inclined at least partially between the upper and lower ends of the elongated body and useful to slideably engage and guide the tubular member as it moves downwardly along the elongated body, the whipstock assembly comprising;

at least one cut-out formed in the elongated body;

a pivotable deflector disposed at least partially within the elongated body in a retracted position and configured to be pivotable at least partially through said cut-out to a deployed position, wherein said deflector in said deployed position protrudes at least partially out of the elongated body through said cut-out, said deflector having a deflector surface, wherein when said deflector is in said deployed position, said deflector surface is at least partially inclined at an outwardly sloping angle that is greater than the incline angle of the outer slide surface of the elongated body and slideably engageable with the tubular member, said deflector in said deployed position being configured to support the tubular member while guiding it farther away from the existing well bore than the outer slide surface as the tubular member passes downwardly along the elongated body and said deflector, wherein said deflector surface is at least partially concave and said deflector is located proximate to the lower end of the elongated body, and wherein said deflector is configured to prevent the tubular member from moving out of alignment with the longitudinal axis of the elongated body when the tubular member is slideably engaged with said deflector; and at least one elongated linear-shaped pusher at least partially disposed within the elongated body and extending at least partially along the longitudinal axis thereof, said at least one pusher being engageable with said deflector and movable between first and second positions, least one pusher being configured so that its movement from said first position to said second position causes said deflector to pivot from said retracted position to said deployed position, and in said second position, said at least one pusher being configured to retain said deflector in said deployed position as said deflector supports the tubular member slideably engaging said deflector surface.

2. The whipstock assembly of claim 1 wherein said deflector in said retracted position is disposed entirely within the elongated body.

3. The whipstock assembly of claim 1 wherein said deflector includes upper and lower ends, further including at least one hinge pin engaged between the elongated body of the whipstock assembly and said deflector, wherein said deflector is pivotable about said at least one hinge pin.

4. The whipstock assembly of claim 3 wherein said at least one hinge pin is engaged between the elongated body of the whipstock assembly and said upper end of said deflector, further wherein said at least one pusher and said deflector are configured so that said at least one pusher will push said lower end of said deflector out of at least one said cut-out to move said deflector into said deployed position.

5. The whipstock assembly of claim 1 wherein said at least one pusher includes at least one rod.

6. The whipstock assembly of claim 1 wherein the whipstock assembly is configured to be landed in an anchor associated with the existing well bore, wherein at least one said pusher is configured to move said deflector into said deployed position upon landing the whipstock assembly in the anchor.

7. The whipstock assembly of claim 6 wherein the existing well bore is a subsea well bore and the anchor is a stump disposed proximate to the sea floor, the stump having an upper end, the whipstock assembly further including an elongated nose extending below the elongated body and being configured to be inserted into the stump, and at least one setting ring engaged with at least one said pusher and slideably movable over an upper portion of said elongated nose, said setting ring being configured to land upon the upper end of the stump and cause at least one said pusher to move said deflector from said retracted position to said deployed position as said elongated nose is inserted into the stump.

8. The whipstock assembly of claim 1 wherein the tubular member is a conductor pipe, the whipstock assembly is configured to be landed in an anchor disposed at the top of the existing well bore and multiple mud-line jacket structural components are disposed proximate to the anchor, further wherein said deflector and said deflector surface are configured to guide the tubular member to a location that is clear of the anchor and the mud-line jacket structural components when said deflector is in said deployed position.

9. The whipstock assembly of claim 8 wherein said deflector is configured in said retracted position to allow passage of the whipstock assembly through at least one pipe guide during deployment thereof to the existing well bore.

10. A whipstock assembly useful for guiding a tubular member to a location proximate to an existing well bore, the whipstock assembly including an elongated body having a longitudinal axis extending from its upper end to its lower end and an outer slide surface extending at least partially along the longitudinal axis, the outer slide surface being inclined at least partially between the upper and lower ends of the elongated body and useful to slideably engage and guide the tubular member as it moves downwardly along the elongated body, the whipstock assembly comprising;

at least one cut-out formed in the elongated body;

a pivotable deflector disposed at least partially within the elongated body in a retracted position and configured to be pivotable at least partially through said cut-out to a deployed position, wherein said deflector in said deployed position protrudes at least partially out of the elongated body through said cut-out, said deflector having a deflector surface, wherein when said deflector is in said deployed position, said deflector surface is at least partially inclined at an outwardly sloping angle that is greater than the incline angle of the outer slide surface of the elongated body and slideably engageable with the tubular member, said deflector in said deployed position being configured to support the tubular member while guiding it farther away from the existing well bore than the outer slide surface as the tubular member passes downwardly along the elongated body and said deflector; and at least one elongated linear-shaped pusher at least partially disposed within the elongated body and extending at least partially along the longitudinal axis thereof, said at least one pusher being engageable with said deflector and movable between first and second positions, said at least one pusher being configured so that its movement from said first position to said second position causes said deflector to pivot from said retracted position to said deployed position, and in said second position, said at least one pusher being configured to retain said deflector in said deployed position as said deflector supports the tubular member slideably engaging said deflector surface, wherein said deflector includes upper and lower ends, further including at least one hinge pin engaged between the elongated body of the whipstock and said lower end of said deflector, wherein said deflector is pivotable about said at least one hinge pin, further wherein said at least one pusher and said deflector are configured so that at least one said pusher will flip over said upper end of said deflector to move said deflector out of at least one said cut-out into said deployed position.

11. The whipstock assembly of claim 10 wherein said at least one pusher includes two rods.

12. A whipstock assembly useful for guiding a tubular member to a location proximate to an existing well bore, the whipstock assembly including an elongated body having a longitudinal axis extending from its upper end to its lower end and an outer slide surface extending at least partially along the longitudinal axis, the outer slide surface being inclined at least partially between the upper and lower ends of the elongated body and useful to slideably engage and guide the tubular member as it moves downwardly along the elongated body, the whipstock assembly comprising;

at least one cut-out formed in the elongated body;

a pivotable deflector disposed at least partially within the elongated body in a retracted position and configured to be pivotable at least partially through said cut-out to a deployed position, wherein said deflector in said deployed position protrudes at least partially out of the elongated body through said cut-out, said deflector having a deflector surface, wherein when said deflector is in said deployed position, said deflector surface is at least partially inclined at an outwardly sloping angle that is greater than the incline angle of the outer slide surface of the elongated body and slideably engageable with the tubular member, said deflector in said deployed position being configured to support the tubular member while guiding it farther away from the existing well bore than the outer slide surface as the tubular member passes downwardly along the elongated body and said deflector;

at least one elongated linear-shaped pusher at least partially disposed within the elongated body and extending at least partially along the longitudinal axis thereof, said at least one pusher being engageable with said deflector and movable between first and second positions, said at least one pusher being configured so that its movement from said first position to said second position causes said deflector to pivot from said retracted position to said deployed position, and in said second position, said at least one pusher being configured to retain said deflector in said deployed position as said deflector supports the tubular member slideably engaging said deflector surface, wherein the whipstock assembly is configured to be landed in an anchor associated with the existing well bore, wherein at least one said pusher is configured to move said deflector into said deployed position upon landing the whipstock assembly in the anchor, wherein the existing well bore is a subsea well bore and the anchor is a stump disposed proximate to the sea floor, the stump having an upper end;

an elongated nose extending below the elongated body and being configured to be inserted into the stump; and at least one setting ring engaged with at least one said pusher and slideably movable over an upper portion of said elongated nose, said setting ring being configured to land upon the upper end of the stump and cause at least one said pusher to move said deflector from said retracted position to said deployed position as said elongated nose is inserted into the stump.

13. The whipstock assembly of claim 12 wherein at least one said setting ring is weight-actuated and configured to move said deflector into said deployed position due to the weight of at least one among the elongated whipstock body and the tubular member.

14. A whipstock assembly useful for guiding a tubular member to a location proximate to an existing well bore, the whipstock assembly including an elongated body having a longitudinal axis extending from its upper end to its lower end and an outer slide surface extending at least partially along the longitudinal axis, the outer slide surface being inclined at least partially between the upper and lower ends of the elongated body and useful to slideably engage and guide the tubular member as it moves downwardly along the elongated body, the whipstock assembly comprising;

at least one cut-out formed in the elongated body;

a pivotable deflector disposed at least partially within the elongated body in a retracted position and configured to be pivotable at least partially through said cut-out to a deployed position, wherein said deflector in said deployed position protrudes at least partially out of the elongated body through said cut-out, said deflector having a deflector surface, wherein when said deflector is in said deployed position, said deflector surface is at least partially inclined at an outwardly sloping angle that is greater than the incline angle of the outer slide surface of the elongated body and slideably engageable with the tubular member, said deflector in said deployed position being configured to support the tubular member while guiding it farther away from the existing well bore than the outer slide surface as the tubular member passes downwardly along the elongated body and said deflector, wherein said deflector includes upper and lower ends and a cam profile proximate to said lower end thereof; and at least one elongated linear-shaped pusher at least partially disposed within the elongated body and extending at least partially along the longitudinal axis thereof, said at least one pusher being engageable with said deflector and movable between first and second positions, said at least one pusher being configured so that its movement from said first position to said second position causes said deflector to pivot from said retracted position to said deployed position, and in said second position, said at least one pusher being configured to retain said deflector in said deployed position as said deflector supports the tubular member slideably engaging said deflector surface, wherein at least one said pusher includes at least one rod having a cam profile engageable with said cam profile of said deflector.

15. The whipstock assembly of claim 14 wherein said at least one pusher includes two rods.

16. The whipstock assembly of claim 15 wherein said deflector in said retracted position is disposed entirely within the elongated body.

17. The whipstock assembly of claim 14 wherein said deflector surface is at least partially concave and said deflector is configured to prevent the tubular member from moving out of alignment with the longitudinal axis of the elongated body when the tubular member is slideably engaged with said deflector.

18. The whipstock assembly of claim 14 wherein the tubular member is a conductor pipe, the whipstock assembly is configured to be landed in an anchor disposed at the top of the existing well bore and multiple mud-line jacket structural components are disposed proximate to the anchor, further wherein said deflector and said deflector surface are configured to guide the tubular member to a location that is clear of the anchor and the mud-line jacket structural components when said deflector is in said deployed position.

19. Apparatus useful for guiding a conductor pipe away from mud-line jacket structural components that are associated with an existing well bore at an offshore hydrocarbon drilling site and located proximate to the stump of the existing well bore at or near the mud-line, the apparatus comprising:

an elongated whipstock body;

a pivotable deflector initially disposed within said elongated whipstock body and pivotably moveable to a deployed position, wherein said deflector in said deployed position protrudes at least partially out of said elongated whipstock body and is configured to support the weight of the conductor pipe while guiding it away from the mud-line jacket structural components, wherein said deflector includes an upper end and a lower end and a cam profile proximate to said lower end; and at least one rod disposed at least partially within said elongated whipstock body, movable between first and second positions and engageable with said deflector, said at least one rod being configured so that its movement from said first position to said second position causes said deflector to pivot into said deployed position, and in said second position, said at least one rod being configured to prevent said deflector from moving back into said elongated whipstock body so that said deflector in said deployed position supports the weight of the conductor pipe while guiding it away from the mud-line jacket structural components, wherein said at least one rod includes a cam profile engageable with said cam profile of said deflector.

20. Apparatus useful for guiding a conductor pipe away from mud-line jacket structural components that are associated with an existing well bore at an offshore hydrocarbon drilling site and located proximate to the stump of the existing well bore at or near the mud-line, the apparatus comprising:

an elongated whipstock body;

a pivotable deflector initially disposed within said elongated whipstock body and pivotably moveable to a deployed position, wherein said deflector in said deployed position protrudes at least partially out of said elongated whipstock body and is configured to support the weight of the conductor pipe while guiding it away from the mud-line jacket structural components;

at least one rod disposed at least partially within said elongated whipstock body, movable between first and second positions and engageable with said deflector, said at least one rod being configured so that its movement from said first position to said second position causes said deflector to pivot into said deployed position, and in said second position, said at least one rod being configured to prevent said deflector from moving back into said elongated whipstock body so that said deflector in said deployed position supports the weight of the conductor pipe while guiding it away from the mud-line jacket structural components; and an elongated nose extending below said elongated whipstock body and being configured to be inserted into the stump, and at least one setting ring engaged with at least one said rod and slideably movable over an upper portion of said elongated nose, said setting ring being configured to land upon the upper end of the stump and cause at least one said rod to move said deflector into said deployed position as said elongated nose is inserted into the stump.

* * * * *

UNITED STATES PATENT AND TRADEMARK OFFICE

CERTIFICATE OF CORRECTION

PATENT NO. : 8,459,345 B2
APPLICATION NO. : 13/487668
DATED : June 11, 2013
INVENTOR(S) : Douglas Bruce Bell It is certified that error appears in the above-identified patent and that said Letters Patent is hereby corrected as shown below:

In the Claims

In claim 1, Column 9, line 67, insert --said at-- before the word “least”.

Signed and Sealed this
Twenty-sixth Day of November, 2013

Margaret A. Focarino

Margaret A. Focarino
*Commissioner for Patents of the United States Patent and Trademark Office*